US007419237B2

(12) United States Patent
Suzuki

(10) Patent No.: US 7,419,237 B2
(45) Date of Patent: Sep. 2, 2008

(54) RECORDING HEAD UNIT

(75) Inventor: Shigeru Suzuki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 194 days.

(21) Appl. No.: 11/095,687

(22) Filed: Apr. 1, 2005

(65) Prior Publication Data

US 2005/0219301 A1 Oct. 6, 2005

(30) Foreign Application Priority Data

Apr. 2, 2004 (JP) ..... 2004-109765

(51) Int. Cl.
*B41J 2/175* (2006.01)

(52) U.S. Cl. ..... 347/18; 347/50; 347/86

(58) Field of Classification Search ..... 347/47, 347/50, 56–58, 18, 68
See application file for complete search history.

(56) References Cited

U.S. PATENT DOCUMENTS 5,428,373 A 6/1995 Shiraishi et al.
7,149,090 B2 12/2006 Suzuki et al.
2004/0227788 A1* 11/2004 Katayama ..... 347/50
2006/0250451 A1 11/2006 Suzuki et al.

FOREIGN PATENT DOCUMENTS

JP 5-177858 A 7/1993
JP 6-064202 A 3/1994
JP 2000-133890 5/2000
JP 2003-080793 A 3/2003

OTHER PUBLICATIONS

JP Office Action dtd May 13, 2008, JP App 2004-109765.

* cited by examiner

*Primary Examiner*—Lam S Nguyen
(74) *Attorney, Agent, or Firm*—Banner & Witcoff, Ltd.

(57) ABSTRACT

A recording head comprises: a plurality of recording elements; a driver for driving the recording elements; a circuit board for supplying to the driver a signal for driving the recording elements; a wiring member connecting the recording elements to the driver, and connecting the driver to the circuit board; and a heatsink for releasing heat generated at the driver. A surface of a first portion of the wiring member is held in contact with a surface of the heatsink, and the first portion of the wiring member is separated from the driver.

23 Claims, 6 Drawing Sheets

RECORDING HEAD UNIT

INCORPORATION BY REFERENCE

The present application is based on Japanese Patent Application No. 2004-109765, filed on Apr. 2, 2004, the content of which is incorporated herein by reference.

BACKGROUND OF THE INVENTION

1. Field of the Invention

The invention relates to a recording head unit of a recording apparatus for performing recording on a recording medium, 2. Description of Related Art A recording head unit of a recording apparatus for performing recording on a recording medium by a plurality of recording elements comprises a driver for driving the recording elements. The driver is constituted by an IC chip, and mounted on a wiring member, such as a flexible wiring board, to be electrically connected to the recording elements via the wiring member. While the recording apparatus is operating, the driver or the IC chip generates heat. To prevent damage of the IC chip from its excessively high temperature due to the heat generated there, it should be ensured that such heat is radiated outward.

There is known a module capable of radiating heat generated at a circuit component generating heat such as an IC chip, where a heatsink is bonded to the circuit component mounted on a printed wiring board such that heat generated at the circuit component is radiated outward via the heatsink, as disclosed in JP-A-2000-133890.

However, depending upon a structure of an apparatus where the module is used, it is often the case that the heat generated at the circuit component can not be sufficiently radiated outward by merely providing such a heatsink bonded to the circuit component. In particular, in the field of recording apparatuses, there has been recently a further increasing demand for miniaturization of the apparatus, and accordingly a tendency of making the recording head unit compact more and more. However, the downsizing of the recording head unit may lead to an insufficient release of the heat generated at the driver to the outside, since it is made difficult to ensure a sufficiently large heat radiating area of the heatsink, or the heat stays inside the recording head unit.

SUMMARY OF THE INVENTION

The present invention has been developed in view of the above-described situations and it is an object of the invention to provide a recording head unit capable of radiating heat generated at a driver.

The above object is attained according to a first aspect of the invention which provides a recording head which comprises: a plurality of recording elements; a driver for driving the recording elements; a circuit board for supplying to the driver a signal for driving the recording elements; a wiring member connecting the recording elements to the driver, and connecting the driver to the circuit board; and a heatsink for releasing heat generated at the driver. A surface of a first portion of the wiring member is held in contact with a surface of the heatsink, and the first portion of the wiring member is separated from the driver.

The recording head is constructed such that the driver selectively drives each of the recording elements based on the signal supplied from the circuit board, and the driven recording element performs recording on the recording medium. The wiring member electrically connecting the recording elements and the driver, and connecting the driver and the circuit board, is held in contact with a surface of the heatsink at a place separated from the driver or a place relatively remote from the driver. Therefore, heat generated at the driver is radiated outward via the heatsink, and is also transmitted from the heatsink to the wiring member to be released therefrom. Thus, the heat is efficiently radiated outward, preventing the temperature of the driver from excessively rising. Further, since the wiring member is held in contact with the heatsink at a place separated from the driver where the temperature is relatively low, a heat transfer from the heatsink to the wiring member is facilitated.

A recording head unit according to a second aspect of the invention comprises: a plurality of recording elements; a driver for driving the recording elements; a circuit board for supplying to the driver a signal for driving the recording elements; a wiring member connecting the recording elements to the driver, and connecting the driver to the circuit board; a heatsink for releasing heat generated at the driver; and an adjacent member which extends along the heatsink. A portion of the wiring member is disposed in a clearance between the adjacent member and the heatsink while the driver is disposed outside the clearance, and the clearance is less than a dimension ten times a thickness of the portion of the wiring member.

According to this arrangement, the heat generated at the driver and transferred to the heatsink is further transferred to a portion of the wiring member disposed between the adjacent member and the heatsink. The features applicable or related to the above-described first aspect of the invention which are defined in the appended claims and the description of embodiments of the invention are applicable to the second aspect of the invention also. That is, to obtain the effect of the second aspect of the invention as described above, it is not necessarily essential that the wiring member contacts the heatsink.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF PREFERRED EMBODIMENTS

Hereinafter, there will be described one embodiment of the invention, as an example where the invention is applied to an inkjet head unit for performing recording by ejecting ink droplets from nozzles onto a recording sheet.

First, there will be briefly described an inkjet printer 1 using an inkjet head unit 2 of the present embodiment.

Figure 1:
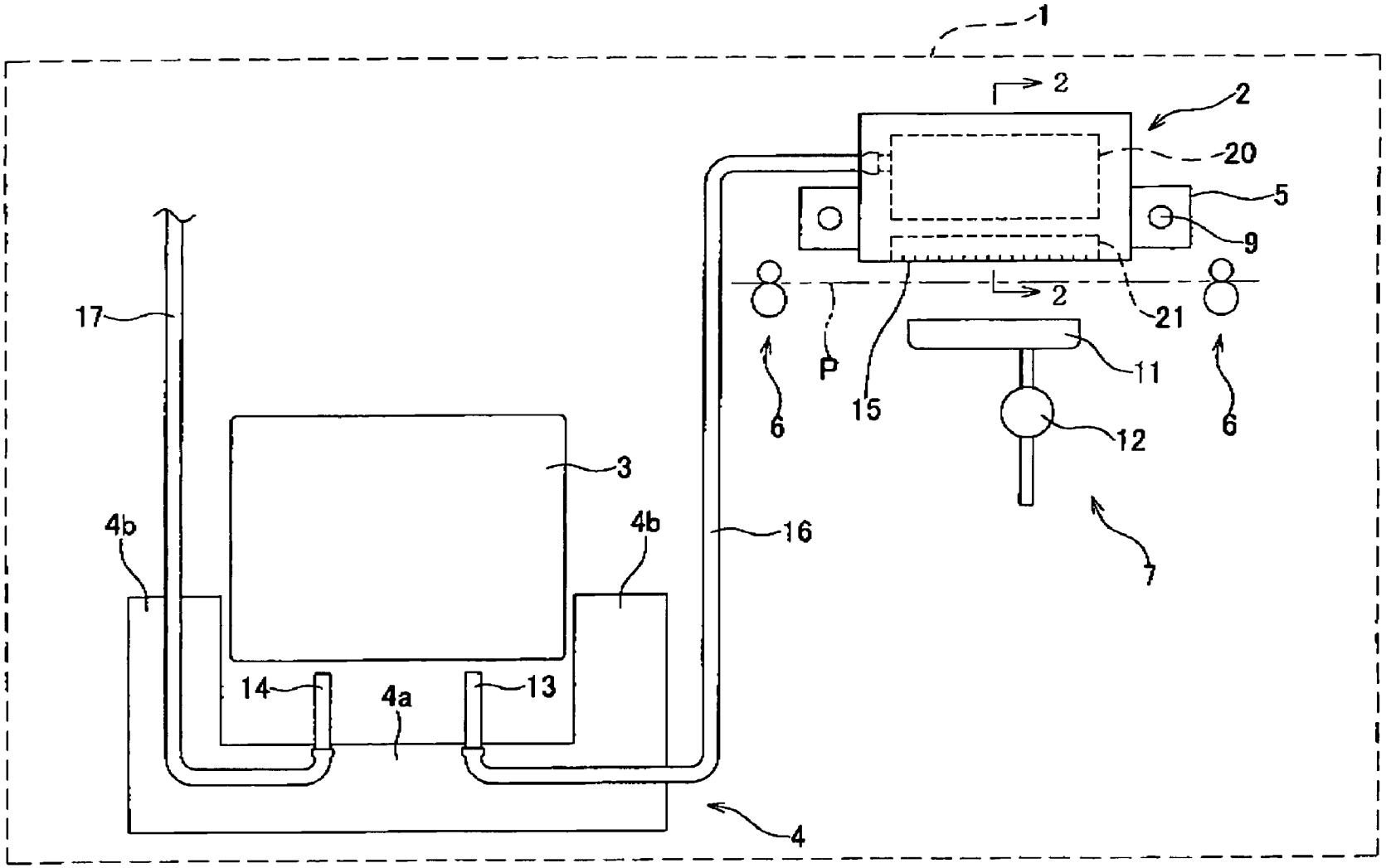
FIG. 1 is a schematic view of an inkjet printer according to one embodiment of the present invention.

The inkjet printer 1 is a color printer and comprises, as shown in FIG. 1, the head unit 2, a mounting portion 4, a carriage 5, a feeding mechanism 6, and a purge mechanism 7. The head unit 2 has a head 200 having an ink ejection surface where nozzles 15 are formed for ejecting droplets of inks of four colors, namely, cyan (C), yellow (Y), magenta (M), and black (K), onto a recording sheet P. On the mounting portion 4, four ink cartridges 3 storing the inks of respective colors (C, Y, M, K) are mounted. The carriage 5 holds the head unit 2 and linearly reciprocates along a guide 9 in a direction perpendicular to a surface of a sheet of paper in which FIG. 1 is presented. The feeding mechanism 6 feeds the recording sheet P in a direction perpendicular to the reciprocating direction of the head unit 2 and parallel to the ink ejection surface of the head 200. The purge mechanism 7 is for sucking ink having a high viscosity due to water evaporation, or air, from the nozzles 15 of the head 200, in order to recover the ink ejection performance of the head 200 to an initial level.

When a printing operation is performed, the recording sheet P is fed by the feeding mechanism 6 in a lateral direction as seen in FIG. 1, while the head unit 2 held by the carriage 5 is reciprocated in the direction perpendicular to the surface of the sheet of paper where FIG. 1 is presented. In the meanwhile, the inks in the ink cartridges 3 mounted on the mounting portion 4 are supplied to the nozzles 15 of the head 200 of the head unit 2 via respective ink supply pipes 16, so that droplets of the inks are ejected from the nozzles 15 onto the recording sheet P to print a desired image or others on the recording sheet P.

The mounting portion 4 comprises a base portion 4*a* and two segments of a guide portion 4*b*, each segment standing upright from two opposite edges of the base portion 4*a*. Ink supply tubes 13 for supplying the respective inks stored in the ink cartridges 3 to the head unit 2, and air supply tubes 14 for introducing atmospheric air into the ink cartridges 3, protrude from the base portion 4*a*. When each ink cartridge 3 is mounted on the mounting portion 4, guided by the guide portion 4*b*, the corresponding ink supply tube 13 and air supply tube 14 are inserted into the ink cartridge 3. An end of each ink supply tube 13 is fitted in a corresponding one of the ink supply pipes 16, and thus the ink supply tube 13 is connected to an ink tank 20 in the head unit 2 through the ink supply pipe 16. On the other hand, an end of each air introducing tube 14 is in communication with the atmosphere via an air introducing tube 17.

The purge mechanism 7 is movable toward and away from the ink ejection surface of the head 200 where the nozzles 15 are formed, and comprises a purge cap 11 attachable to the head 200 to cover the ink ejection surface and a suction pump 12 for sucking the ink in the nozzles 15. When it is required to recover the ink ejection performance of the head 200, the suction pump 12 is operated to suck from the nozzles 15 the air undesirably introduced into the head 200 and the ink having a high viscosity due to water evaporation. This recovering process is performed while the head unit 2 is located out of a printing area with respect to the recording sheet P.

There will be now described the head unit 2.

Figure 2:
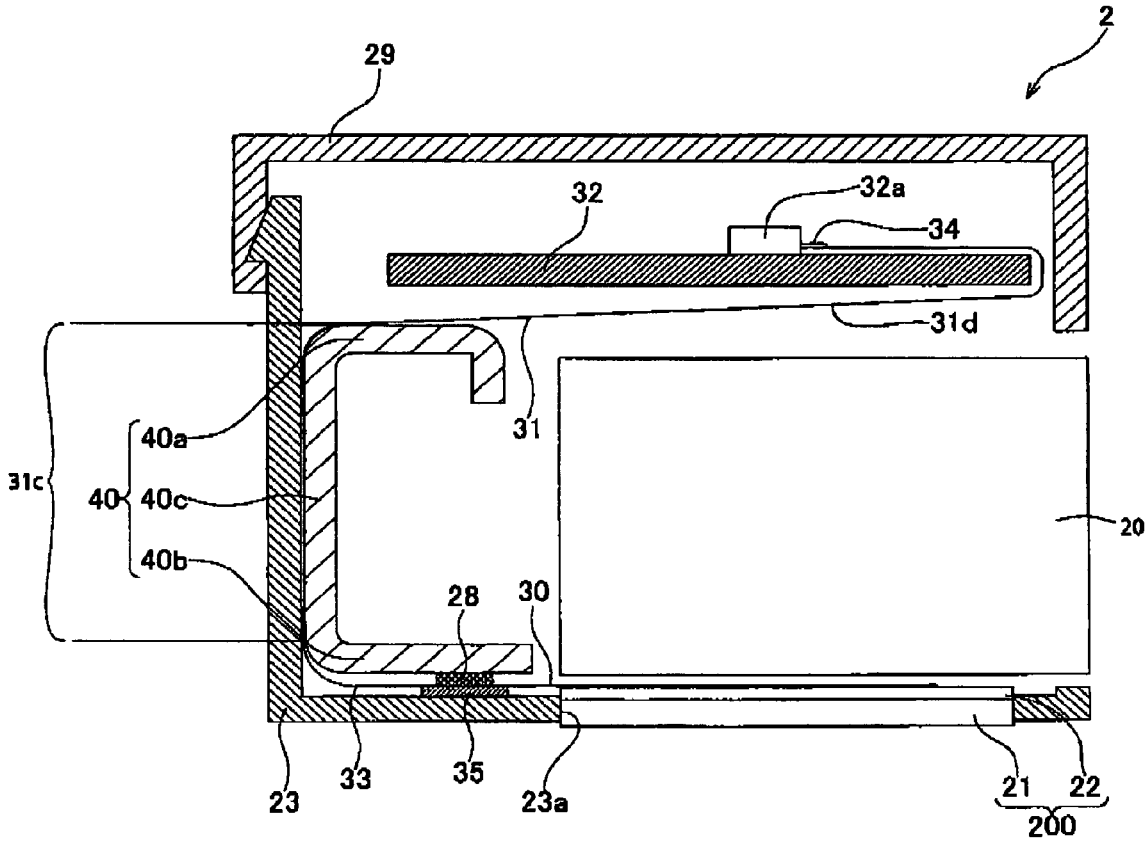
FIG. 2 is a cross-sectional view of an inkjet head unit, as taken along a line 2-2 in FIG. 1.
Figure 3:
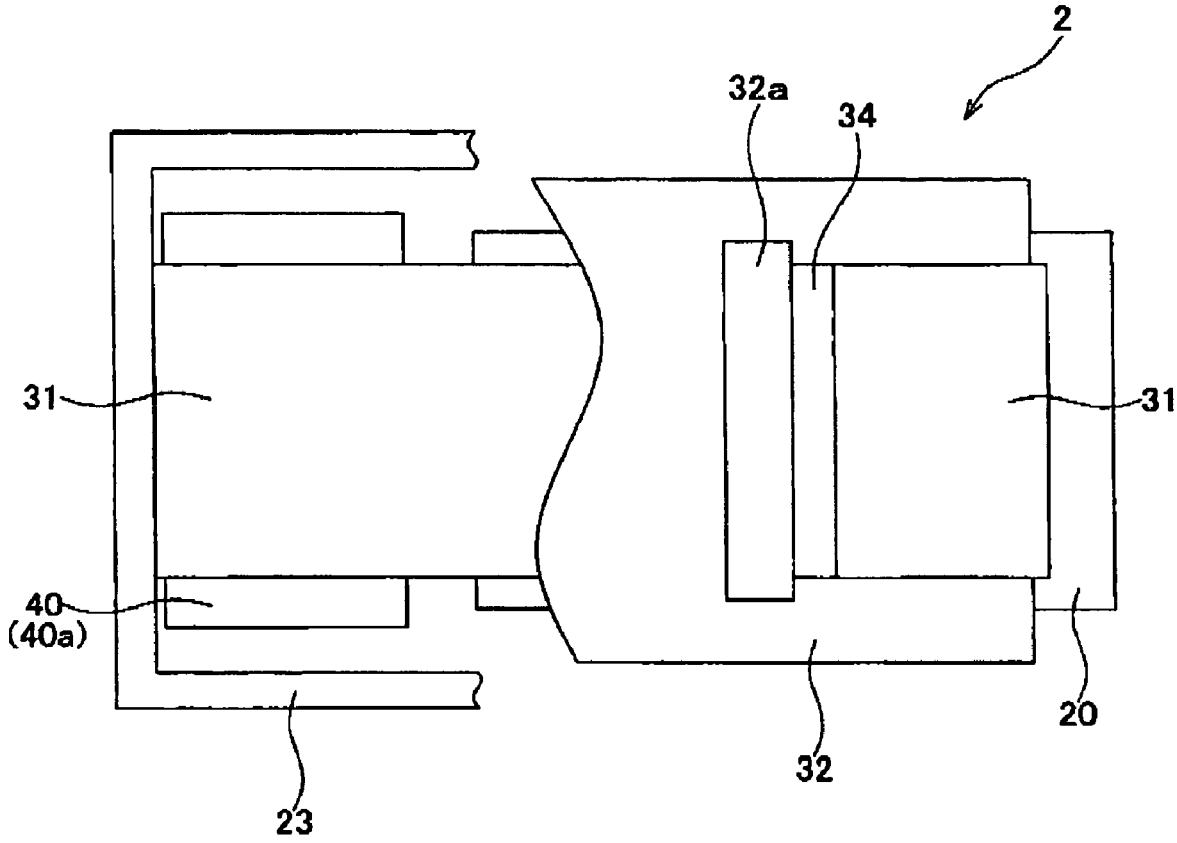
FIG. 3 is a plan view of the head unit where a head cover is removed.

As shown in FIGS. 2 and 3, the head unit 2 comprises the ink tank 20 for storing the inks, the head 200 located under the ink tank 20 and ejecting inks from the nozzles 15 in accordance with drive signals. The head 200 comprises a passage unit 21 in which ink passages are formed, and an actuator unit 22 bonded to an upper surface of the passage unit 21.

The ink tank 20 is fixedly disposed on a holder 23 which is open on its upper side, and inside the ink tank 20 are defined four compartments (not shown) for storing the inks of respective colors. The ink tank 20 is connected to the ink supply tubes 13 via the ink supply pipes 16 (shown in FIG. 1), and the inks in the four ink cartridges 3 are respectively supplied to the four compartments in the ink tank 20 via the ink supply tubes 13 and ink supply pipes 16.

Figure 4:
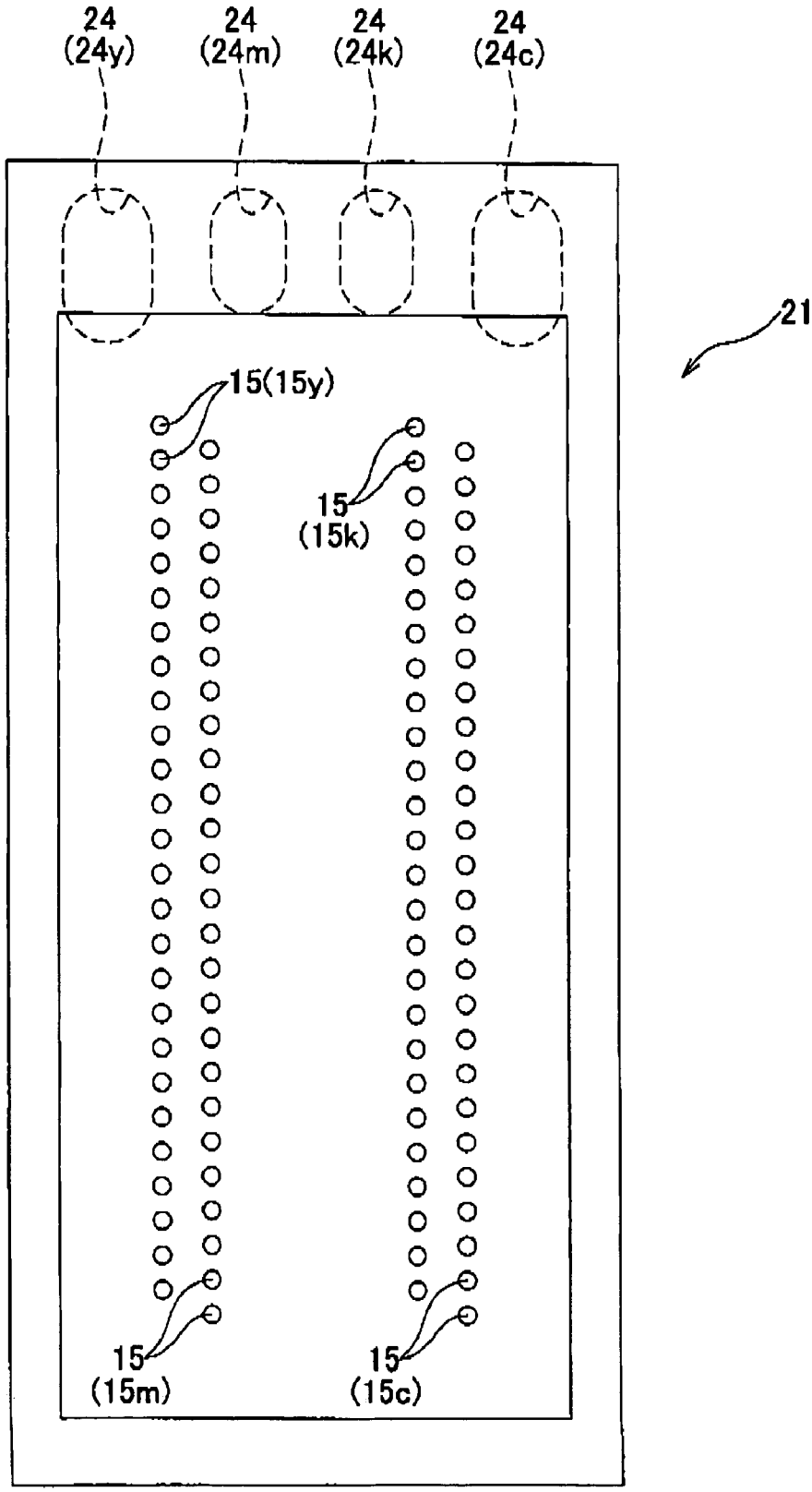
FIG. 4 is a bottom view of a passage unit.
Figure 5:
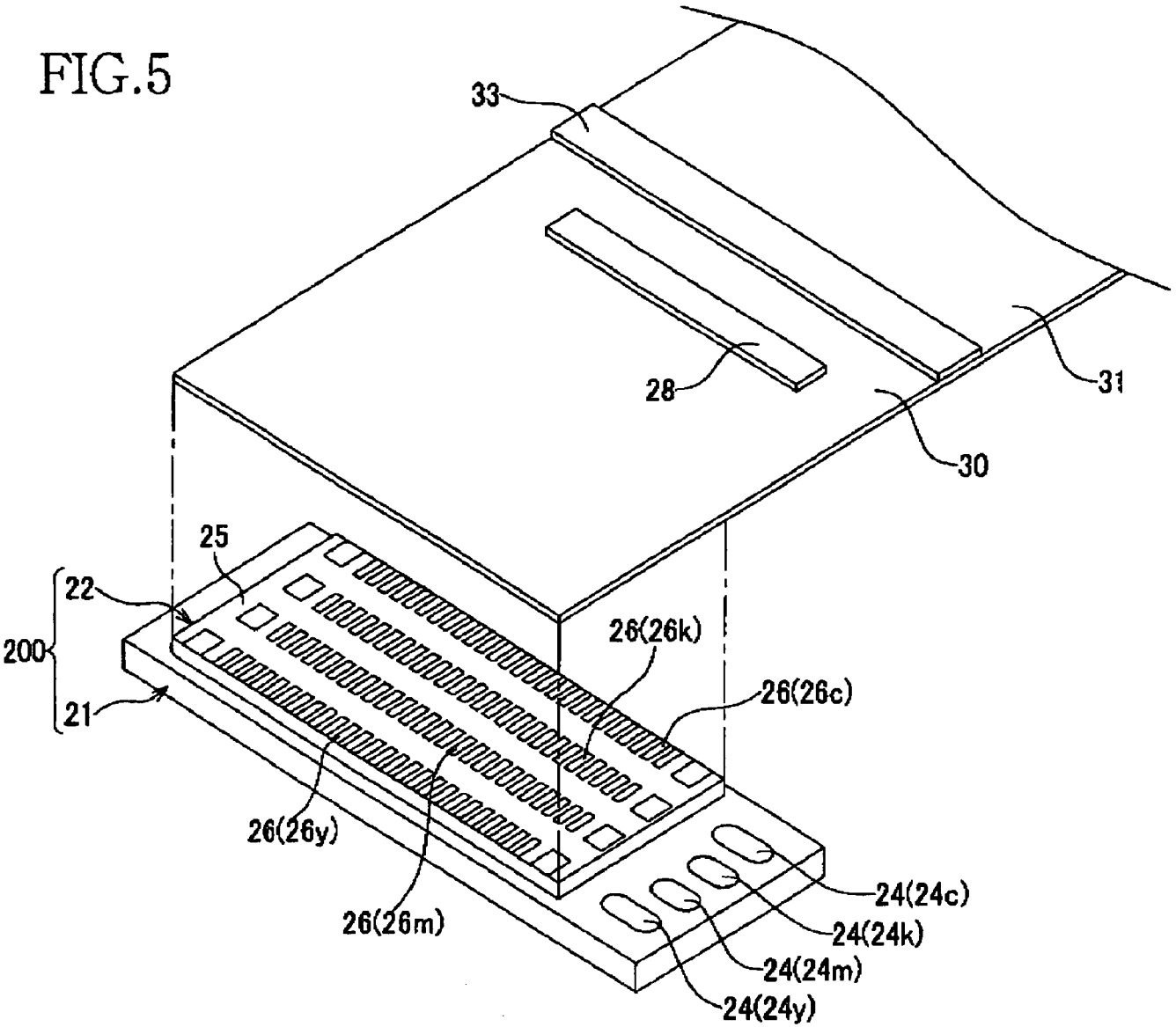
FIG. 5 is an exploded perspective view of a relevant portion of a head, including the passage unit and an actuator unit.

The passage unit 21 has a laminar structure comprising a plurality of metallic sheets. As shown in FIGS. 4 and 5, four ink supply ports 24 (24*c*, 24*y*, 24*m*, 24*k*), respectively corresponding to the inks of four colors and each having an oblong shape as seen from the upper side, are open in the upper surface of the passage unit 21. On the other hand, a lower surface of the passage unit 21 constitutes the ink ejection surface where the nozzles 15 are arranged in four rows 15*c*, 15*y*, 15*m*, 15*k*. Although not shown, inside the passage unit 21 are formed a plurality of pressure chambers respectively in communication with the nozzles 15, manifold passages respectively extending from the ink supply ports 24, and individual ink passages branching off or extending from the manifold passages to the nozzles 15 via the pressure chambers.

The compartments defined in the ink tank 20 are respectively in communication with the four ink supply ports 24, via which the inks in the compartments are supplied to the passage unit 21. As shown in FIG. 2, the passage unit 21 is fitted in an opening 23*a* formed through a bottom wall of the holder 23 such that the ink ejection surface of the passage unit 21 where the nozzles 15 are formed is exposed to the outside. When a printing operation is performed, ink droplets are ejected downward from the nozzles 15 formed in the ink ejection surface.

As shown in FIG. 5, the actuator unit 22 comprises a laminate comprising a plurality of piezoelectric sheets 25, and a plurality of individual electrodes 26 which are formed among the piezoelectric sheets 25 at positions respectively corresponding to the pressure chambers in the passage unit 21. The individual electrodes 26 are arranged in four rows 26*c*, 26*y*, 26*m*, 26*k* corresponding to the four nozzle rows 15*c*, 15*y*, 15*m*, 15*k*. To an upper surface of the actuator unit 22, a flexible printed wiring board or an FPC (Flexible Printed Circuit board) 30 is bonded. The FPC 30 extends in a horizontal direction (i.e., leftwards as seen in FIG. 2) from the actuator unit 22. On an upper surface of the FPC 30, a driver IC 28 constituting a driver is mounted, so that the driver IC 28 and the individual electrodes are electrically connected through the FPC 30.

When a drive signal in the form of pulses is supplied from the driver IC 28 selectively to one of the individual electrodes 26 via the FPC 30, a place in the piezoelectric sheets 25 corresponding to the individual electrode 26 is deformed to increase the pressure in the corresponding pressure chamber to eject an ink droplet from the nozzle 15 corresponding to the pressure chamber. It is noted that an individual ink passage including a nozzle 15 and a pressure chamber, and an individual actuator comprising an individual electrode 26 and the piezoelectric sheets 25, constitute each recording element.

Figure 6:
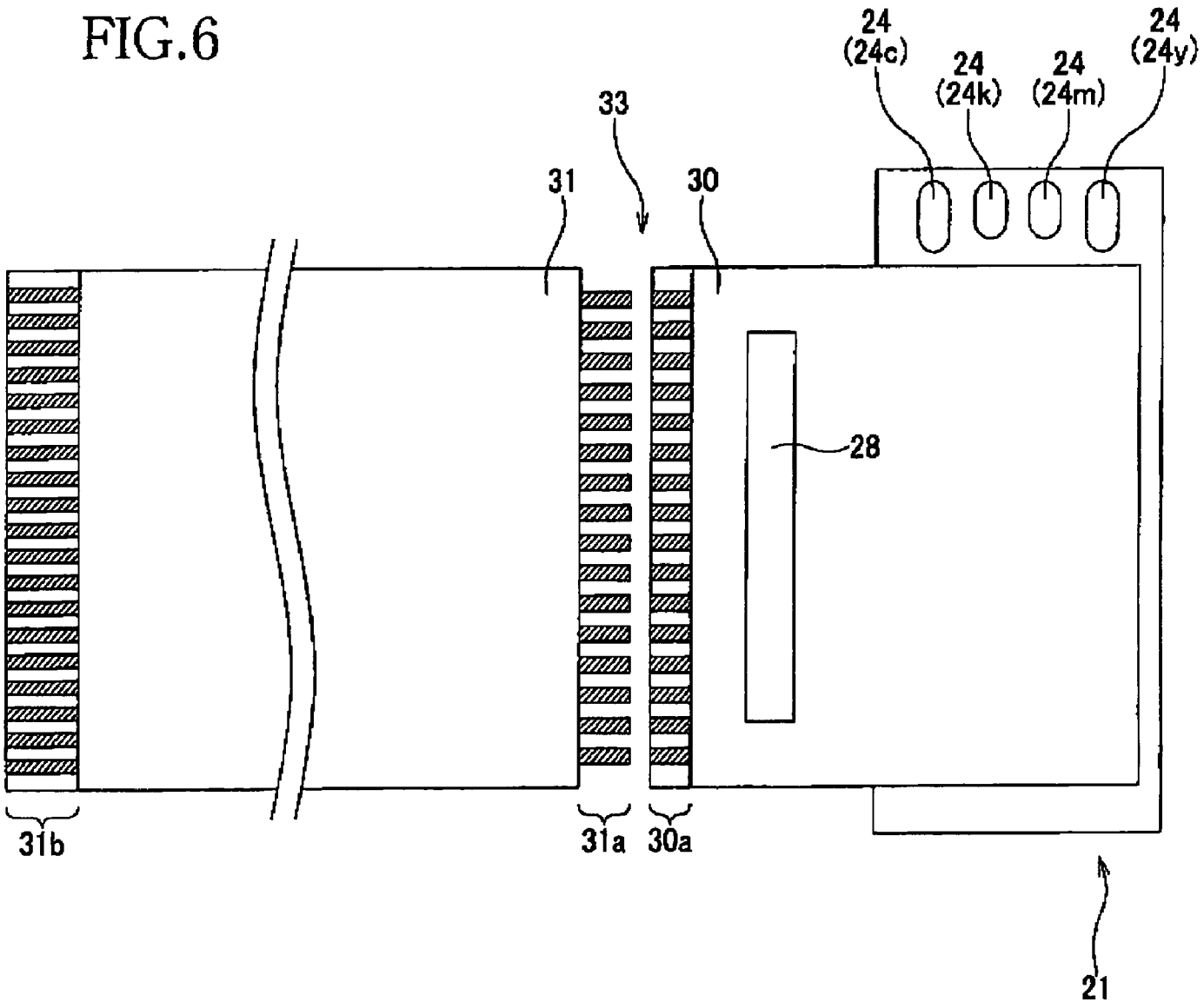
FIG. 6 is a plan view of an FPC and FFC.

As will be described later, a flexible flat cable (FFC) is connected to the FPC 30, as shown in FIGS. 5 and 6. The FFC 31 is a cable whose conductor or wire(s) is not formed by printing, and electrically connects the driver IC 28 mounted on the FPC 30 and a relay board 32 disposed in the holder 23. The relay board 32 is electrically connected to a controller (not shown) for controlling general operation of the inkjet printer 1, so as to receive signals from the controller, and output to the driver IC 28 signals for having the nozzles 15 eject ink droplets, or for driving the recording elements.

As shown in FIG. 2, in the head unit 2, the driver IC 28, a circuit component mounted on the relay board 32, etc. are accommodated in the holder 23 whose upper side is covered by a removably attached head cover 29, so as to prevent damage of the driver IC 28, circuit component, etc., due to electrostatic discharge.

There will next be described a structure of connection between the individual electrodes 26 and the driver IC 28, and between the driver IC 28 and the relay board 32.

As shown in FIGS. 2 and 5, the individual electrodes 26 and the driver IC 28 are connected via the FPC 30. The FPC 30 has input side wiring and output side wiring which are connected to an input side and an output side of the driver IC 28, respectively. The wiring of both the input and output side is formed by being printed on an electrically insulating film such as that of polyimide. An end of the output side wiring is connected to the individual electrodes 26 of the actuator unit 22. In this embodiment, the thickness of the input and output side wiring is about 10 μm, and the total thickness of the FPC 30 including the wiring is about 50 μm.

The driver IC 28 generates drive signals by conversion from bit serial to bit parallel, namely, the driver IC 28 receives recording data serially transmitted from the controller (not shown) of the inkjet printer 1 via the relay board 32, and sends out drive signals in parallel to the individual electrodes 26. Since the number of wires of the output side wiring (i.e., the wiring on the side of the individual electrodes) in the FPC 30 needs to be equal to or more than the number of the nozzles 15 at least, the wiring density of the pattern of the output side wiring is relatively high. On the other hand, the input side wiring (i.e., the wiring on the side to be connected with the FFC 31 as will be described later) in the FPC 30 is required to provide only electric lines such as a signal power line, a drive power line, a ground line, and a plurality of recording data signal lines, transfer clock signal lines, and latch signal lines, the number of each of which corresponds to the number of serial-parallel converters provided correspondingly to the color inks, namely, four. That is, the input side wiring is constituted by a considerably small number of lines compared to the output side wiring.

The FFC 31, to which the FPC 30 is connected, is a general-purpose FFC, and has wiring of a pattern comprising parallel lines of the same number as the input side wiring in the FPC 30. Through this FFC 31, the FPC 30, on which the driver IC 28 is mounted, and the relay board 32 are electrically connected. As shown in FIG. 6, a terminal 31*a* of the FFC 31 at one of its opposite ends is connected to an input side terminal 30*a* of the FPC 30, and a terminal 31*b* of the FFC 31 at the other end thereof is connected to the relay board 32. The input side terminal 30*a* of the FPC 30 and the terminal 31*a* at an end of the FFC 31 are bonded to each other by being heated, with their exposed wires superposed on each other, so that an electrically conductive metal or solder which has been put beforehand on one of the terminals 30*a*, 31*a* are melted. To the thus formed bonding portion 33 is attached an electrically insulating tape (not shown) to cover the side of the bonding portion 33 where the wires are exposed. As shown in FIGS. 2 and 3, a reinforcing sheet 34 is bonded to the terminal 31*b* of the FFC 31 on the side of the relay board 32, by thermal welding or bonding with an adhesive, for instance. The reinforcing sheet 34 is of an electrically insulating film having a rigidity higher than that of the FFC 31 so as to facilitate the attaching of the FFC 31 to a connector 32*a* of the relay board 32. The electrically conductive wiring of the FFC 31 has a thickness larger than that of the wiring of the FPC 30, since it is not required to have the pitch of the wiring pattern of the FFC 31 as narrow as that of the FPC 30. In the present embodiment, the thickness of the wiring in the FFC 31 is about 50 μm, and this wiring is covered on both sides with an electrically insulating resin. The total thickness of the FFC 31 is about 170 μm.

The FPC 30 is produced exclusively for the head unit 2 and accordingly expensive. Particularly in a case where the number of the nozzles 15 is relatively large to achieve high image quality, or, where the nozzles 15 are arranged in a relatively high density to downsize the head unit 2, there is narrowed the pitch of the wiring of the FPC 30 connecting the individual electrodes 26 respectively corresponding to the nozzles 15, with the driver IC 28, which pushes up the manufacturing cost of the FPC 30. On the other hand, the FFC 31 is available at a significantly lower price compared to the FPC 30. According to this embodiment, since the FPC 30 is connected to the relay board 32 via the inexpensive FFC 31, there is decreased the amount of a portion in the connection between the FPC 30 and the relay board 32 which is constituted by the expensive FPC 30, enabling to reduce the manufacturing cost of the head unit 2.

As shown in FIG. 2, a metallic heatsink 40 is disposed in the holder 23 and adjacent to the ink tank 20. The heatsink 40 comprises a top part 40*a*, a bottom part 40*b*, and a side part 40*c* formed integrally with the top and bottom parts 40*a*, 40*b* and vertically extending. Thus, the heatsink 40 has a generally C-shape in vertical cross section. The driver IC 28 is held in close contact with an outer or lower surface of the bottom part 40*b* of the heatsink 40 by being pressed against the bottom part 40*b* by an elastic member 35 disposed on a surface of the FPC 30 opposite to the surface on which the IC driver 28 is mounted. Hence, it is ensured that heat generated at the driver IC 28 during a printing operation is transferred to the heatsink 40 and therefrom radiated outward.

If the heat transmitted to the heatsink 40 is not satisfactorily radiated to the outside of the head unit 2, the temperature of a chip constituting the IC driver 28 may rise beyond its heat-proof temperature (e.g., 100° C.), resulting in damage of the chip. In particular, in the head unit 2 according to this embodiment where the principal portion of the head unit 2 including the driver IC 28, relay board 32 and heatsink 40 is enclosed in the holder 23 and head cover 29 so as to prevent damage of the IC 28 and circuit component of the relay board 32 due to electrostatic discharge, as shown in FIG. 2, the heat tends to stay around the heatsink 40 and is not satisfactorily radiated to the outside of the head unit 2. When the surface area of the heatsink 40 is increased to solve this problem, the size of the heatsink 40 is increased, leading to an undesirable increase in the size of the head unit 2. Further, since the head 200 is disposed adjacent to the driver IC 28 generating the heat, the temperature of the head 200 varies from place to place depending upon the distance from the driver IC 28. This causes a variation in the ink ejection performance from nozzle to nozzle, which may deteriorate the printing quality.

In view of the aforementioned situations, in the head unit 2 of this embodiment, the FFC 31, which is connected to the FPC 30 at the bonding portion 33, extends to the relay board 32 between an outer surface of the side part 40*c* of the heatsink 40 and a side wall of the holder 23, as shown in FIG. 2. That is, the FFC 31 extends through a narrow clearance slightly larger than a thickness of the FFC 31 between the heatsink 40 and the side wall of the holder 23 (but not being sandwiched tightly therebetween) such that at least a part of a portion 31*c* of the FFC 31 is held in contact with an outer surface of the side part 40*c* and top part 40*a* of the heatsink 40 which parts 40*c*, 40*a* are separated or relatively remote from the driver IC 28. To ensure a satisfactory heat release, the contact portion 31*c* of the FFC 31 is sufficiently separated from the portion of the FFC 31 contacting the IC driver 28, and it is preferable that the distance between the contact portion 31*c* and the portion of the FFC 31 contacting the IC driver 28 is larger than a length of the portion contacting the IC driver 28. Although the FFC 31 is in contact with the holder 23 also, most of the heat is conducted to a portion 31*d* of the FFC 31 since a heat conducting ability of the FFC 31 is higher than that of the holder 23. The clearance between the heatsink 40 and the side wall of the holder 23 is preferably less than a dimension ten times, more preferably five times, further preferably three times, and still further preferably twice, the thickness of the FFC 31. It is further preferable that the clearance is less than a dimension 1.5 times the thickness of the FFC 31. That is, the less the clearance is, the more it is preferable.

The relay board 32 is disposed in a horizontal position and over the heatsink 40 and the ink tank 20. On an upper surface of the relay board 32, the connector 32*a* is disposed. The connector 32*a* is connected to the FFC 31 on its side opposite to the heatsink 40, i.e., the right-hand side as seen in FIG. 2, and thereby the relay board 32 and the terminal 31*b* of the FFC 31 are connected. Thus, a part of the FFC 31 on the side of the relay board 32 extends to be off the top part 40*a* of the heatsink 40, such that the part turns at an edge of the relay board 32 on the side opposite to the heatsink 40 from the under side of the relay board 32 to the upper side so that the terminal 31*b* of the FFC 31 is connected to the connector 32*a*. That is, the FFC 31 is formed to maximize a surface area of a non-contact portion of the FFC 31 at which the FFC 31 is off and not in contact with the heatsink 40, and which extends in a space relatively remote from the driver IC 28 and the head 200 whose ink ejection performance may be affected by the heat generated at the driver IC 28.

Therefore, most of the heat generated at the driver IC 28 is first transferred to the heatsink 40, and then transferred therefrom directly to the atmospheric air, as well as to the FFC 31. The heat transferred to the FFC 31 is conducted to the non-contact portion of the FFC 31 extending away from the heatsink 40 to the relay board 32. The non-contact portion not in contact with the heatsink 40 is surrounded by the atmospheric air which is present on the side of the ink tank 20 (that is, the air present in a place remote from the heatsink 40) and has a relatively low temperature, and thus the heat is easily conducted from the FFC 31 to the atmospheric air. In short, the FFC 31 is configured to be partially in contact with the heatsink 40 and extend to the side away from the heatsink 40, so that the surface area of the FFC 31 is increased, thereby enhancing the heat release by the heatsink 40 in effect. As described above, since the heat generated at the driver IC 28 is radiated outward directly from the heatsink 40, as well as via the FFC 31, the heat is efficiently released, and an excessive rise in the temperature of the driver IC 28 is prevented with reliability. Further, since the heatsink 40 functions as an excellent heat absorber for the driver IC 28, the heat generated at the driver IC 28 is less transmitted to the head 200 via the FPC 30 and holder 28, preventing occurrence of the variation in the ink ejection performance due to the uneven temperature distribution in the head 200.

It is desirable that a surface area of the contact portion 31*c* at least a part of which contacts the heatsink 40 is sufficiently large, and in the present embodiment this surface area of the contact portion 31*c* is more than four times larger than a surface area of the driver IC 28 over which the driver IC 28 is held in close contact with the heatsink 40, as shown in FIG. 2. However, the surface area of the contact portion 31*c* may be less than four times larger than the surface area of the driver IC 28, namely, it may be arranged such that the surface area of the contact portion 31*c* is three or two times larger than the surface area of the driver IC 28. By this arrangement, most of the heat generated at the driver IC 28 is transferred to the heatsink 40, enabling to further efficiently release the heat. In addition, a surface area of the portion 31*d* of the FFC 31 extending away from the heatsink 40, or between the heatsink 40 and the relay board 32, is preferably larger than that of the contact portion 31*c* at which the FFC 31 contacts the heatsink 40, so as to release the heat transferred to the FFC 31 from the heatsink 40, in an increased amount from the portion 31*d* of the FFC 31 off the heatsink 40.

In the present embodiment, the FPC 30 electrically connecting the driver IC 28 and the individual electrodes 26 is connected at its input side with the FFC 31 which is connected to the relay board 32, and the FFC 31 is held in contact with the heatsink 40. Generally, a total cross-sectional area of a conductor constituting a wiring affects the heat conducting ability of the wiring. In this embodiment, a total cross-sectional area of the conductor constituting the wiring of the FFC 31 is about 2.5 times larger than that of the input side wiring of the FPC 30, meaning that the FFC 31, which generally has a heat capacity larger than that of the FPC 30 as well, has a heat conducting ability higher than that of the input side wiring of the FPC 30. Therefore, compared to a case where it is the FPC 30 that is held in contact with the heatsink 40, the heat from the heatsink 40 is more easily transferable to the portion 31*d* off the heatsink 40, further enhancing the efficiency of releasing the heat outward from the driver IC 28.

As described above, the number of wires of the FPC 30 is large on its output side with respect to the driver IC 28 (i.e., the wiring on the side of the individual electrodes 26), and small on its input side (i.e., the wiring on the side of the FFC 31). Hence, the pitch and width of the wires or lines on the output side are both relatively narrow, while the width of each wire or line is wider on the input side than the output side, correspondingly to the smaller number of the wires or lines, although it is required to provide a clearance between each adjacent two wires or lines to ensure electrical insulation. In this embodiment, a percentage of a surface area occupied by the wiring in the surface of the FPC 30 is about 60% on the output side, and about 90% on the input side. In view of the fact that the heat transferred from the driver IC 28 to the FPC 30 is mainly conducted through the electrically conductive wiring, the amount of heat conducted to the input side of the FPC 30 is about 1.5 times larger than that conducted to the output side. In other words, the heat at the driver IC 28 tends to be relatively easily conducted to the FFC 31 via the FPC 30, but does not tend to be conducted to the head 200. This enhances functions of the heatsink 40 enlarged in effect by its contact with the FFC 31, that is, to absorb the heat generated at the driver IC 28 and release the heat at a place remote from the driver IC 28 and head 200. Further, the arrangement where the heat at the driver IC 28 is difficult to be conducted to the head 200 contributes to prevent ink ejection performance of the head 200 from being adversely affected by the heat.

There will be described several modifications of the embodiment. Parts or elements identical with those of the above-described embodiment will be referred to by the same reference numerals, and description thereof is dispensed with.

(1) In the above-described embodiment, a wiring member formed by bonding the FPC 30 and the FFC 31 to each other electrically connects the individual electrodes 26 with the driver IC 28, and connects the driver IC 28 with the relay board 32, and only the FFC 31 is held in contact with the heatsink 40. However, both of the FPC 30 and the FFC 31 may be held in contact with the heatsink 40. Further, the individual electrodes 26, the driver IC 28, and the relay board 32 may be electrically connected solely by an FPC 30. When only an FPC 30 is used to connect the individual electrodes 26, driver IC 28 and relay board 32, the FPC 30 should be held in contact with the heatsink 40 at a place remote from the driver IC 28.

(2) The invention is applicable to a case where the driver IC 28 is not in direct contact with the heatsink 40, such as the case where the driver IC 28 is disposed on the surface of the FPC 30 opposite to the surface on which the heatsink 40 is disposed.

(3) The heatsink is not limited to the above-described one having a C-like shape in cross section. For instance, there may be employed an arrangement where a heatsink in the form of a metallic plate extends vertically and in parallel with a side wall of the holder 23, and a wiring member such as an FPC 30 and FFC 31 is held in contact with an outer surface of the plate or heatsink.

(4) The clearance in which the wiring member is disposed may be defined between the heatsink and a member other than the holder 23.

(5) The present invention is applicable to a recording head for a printer not of inkjet type, such as a thermal printer and dot printer.

What is claimed is:

1. A recording head unit comprising:
a plurality of recording elements;
a driver for driving the recording elements;
a circuit board for supplying to the driver a signal for driving the recording elements;
a wiring member connecting the recording elements to the driver, and connecting the driver to the circuit board; and
a heatsink for releasing heat generated at the driver,
wherein a surface of at least a part of a first portion of the wiring member is in contact with a surface of the heatsink, the first portion of the wiring member being separated from the driver.

2. The recording head unit of claim 1, further comprising an adjacent member which extends near and along the heatsink, the first portion of the wiring member being disposed in a clearance between the adjacent member and the heatsink.

3. The recording head unit of claim 2, wherein the adjacent member is a side wall of a holder holding the recording elements, the driver, the circuit board, the wiring member, and the heatsink.

4. The recording head unit of claim 2, wherein the clearance is less than a dimension ten times a thickness of the first portion of the wiring member.

5. The recording head unit of claim 1, wherein the wiring member has a second portion between the first portion and a third portion thereof, a surface of the third portion being in contact with the driver.

6. The recording head unit of claim 5, wherein a length of the second portion which is away from the surface of the heatsink is longer than a length of the third portion in a direction of extension of the wiring member.

7. The recording head unit according to claim 5, wherein the driver is disposed on the surface of the third portion of the wiring member and held in contact with the heatsink.

8. The recording head unit according to claim 7, wherein an elastic member is disposed on a surface of the third portion opposite to its surface on which the driver is disposed, so as to press the driver onto the heatsink.

9. A recording head unit comprising:
a plurality of recording elements;
a driver for driving the recording elements;
a circuit board for supplying to the driver a signal for driving the recording elements;
a wiring member connecting the recording elements to the driver, and connecting the driver to the circuit board; and
a heatsink for releasing heat generated at the driver,
wherein a surface of at least a part of a first portion of the wiring member is in contact with a surface of the heatsink, the first portion of the wiring member being separated from the driver, and
wherein a surface area of the surface of the first portion is at least two times larger than a surface area of the driver where the driver is held in contact with the heatsink.

10. The recording head unit according to claim 9, wherein the surface area of the surface of the first portion is at least three times larger than the surface area of the driver.

11. The recording head unit according to claim 10, wherein the surface area of the surface of the first portion is at least four times larger than the surface area of the driver.

12. The recording head unit according to claim 1, wherein a fourth portion of the wiring member on the side of the circuit board extends off and away from the heatsink to the circuit board.

13. The recording head unit according to claim 12, wherein the fourth portion extends in the air.

14. The recording head unit according to claim 12, wherein a surface area of the fourth portion extending away from the heatsink to the circuit board is larger than that of the first portion of the wiring member where the wiring member is held in contact with the heatsink.

15. The recording head unit according to claim 1,
wherein the wiring member comprises a first flexible wiring member which is connected to the recording elements and on which the driver is mounted, and a second flexible wiring member which is connected to the circuit board and bonded to the first flexible wiring member,
and wherein the first portion of the wiring member is a portion of the second flexible wiring member.

16. A recording head unit comprising:
a plurality of recording elements;
a driver for driving the recording elements;
a circuit board for supplying to the driver a signal for driving the recording elements;
a wiring member connecting the recording elements to the driver, and connecting the driver to the circuit board; and
a heatsink for releasing heat generated at the driver;
an adjacent member which extends along the heatsink,
wherein a surface of at least a part of a first portion of the wiring member is in contact with a surface of the heatsink, the first portion of the wiring member being separated from the driver,
wherein the heatsink comprises a first part extending substantially parallel to a surface in which the recording elements are arranged, a second part extending in a direction intersecting the first part from one of opposite edges of the first part which remote from the recording elements,
and wherein the surface of the first portion of the wiring member is held in contact with the second part of the heatsink.

17. The recording head unit according to claim 16, wherein the heatsink is generally C-shaped and further comprises a third part extending from one of opposite edges of the second part which is remote from the first part in a direction intersecting the second part.

18. The recording head unit according to claim 17, wherein the wiring member is partially in contact with the third part of the heatsink.

19. A recording head unit comprising:
a plurality of recording elements;

a driver for driving the recording elements;

a circuit board for supplying to the driver a signal for driving the recording elements;

a wiring member connecting the recording elements to the driver, and connecting the driver to the circuit board; and a heatsink for releasing heat generated at the driver, wherein a surface of at least a part of a first portion of the wiring member is in contact with a surface of the heatsink, the first portion of the wiring member being separated from the driver, wherein the wiring member comprises a first flexible wiring member which is connected to the recording elements and on which the driver is mounted, and a second flexible wiring member which is connected to the circuit board and bonded to the first flexible wiring member, wherein the first portion of the wiring member is a portion of the second flexible wiring member, and wherein a total cross-sectional area of a conductive wiring pattern of the second flexible wiring member is larger than that of a part of the first flexible wiring member on the side of which the first flexible wiring member is connected to the second flexible wiring member.

20. The recording head unit according to claim 19, wherein the total cross-sectional area of the conductive wiring pattern of the second flexible wiring member is at least two times larger than that of the part of the first flexible wiring member.

21. The recording head unit according to claim 19, wherein the first flexible wiring member is a flexible printed circuit board (FPC), while the second flexible wiring member is a flexible flat cable (FFC).

22. A recording heat unit comprising:

a plurality of recording elements;

a driver for driving the recording elements;

a circuit board for supplying to the driver a signal for driving the recording elements;

a wiring member connecting the recording elements to the driver, and connecting the driver to the circuit board;

a heatsink for releasing heat generated at the driver; and an adjacent member which extends along the heatsink, wherein a portion of the wiring member is disposed in a clearance between the adjacent member and the heatsink while the driver is disposed outside the clearance, the clearance being less than a dimension ten times a thickness of the portion of the wiring member.

23. The recording head unit according to claim 22, wherein the wiring member comprises a first flexible wiring member which is connected to the recording elements and on which the driver is mounted, and a second flexible wiring member which is connected to the circuit board and bonded to the first flexible wiring member and has a higher heat conducting ability than the first wiring member, and wherein the portion of the wiring member disposed in the clearance is a portion of the second wiring member.

* * * * *

UNITED STATES PATENT AND TRADEMARK OFFICE

CERTIFICATE OF CORRECTION

PATENT NO. : 7,419,237 B2
APPLICATION NO. : 11/095687
DATED : September 2, 2008
INVENTOR(S) : Shigeru Suzuki It is certified that error appears in the above-identified patent and that said Letters Patent is hereby corrected as shown below:

In Column 10, Claim 16, Line 44:
Please delete "an adjacent member which extends along the heatsink"

In Column 10, Claim 16, Line 53:
Please remove "which remote" and insert --which is remote--

Signed and Sealed this

Second Day of June, 2009

JOHN DOLL
*Acting Director of the United States Patent and Trademark Office*